US011657961B2

(12) United States Patent
Bustreo et al.

(10) Patent No.: US 11,657,961 B2
(45) Date of Patent: May 23, 2023

(54) METHOD AND CONDUCTOR STRUCTURE FOR MANUFACTURING AN ELECTRIC WINDING OF AN ELECTROMAGNETIC INDUCTION APPARATUS

(71) Applicant: Hitachi Energy Switzerland AG, Baden (CH)

(72) Inventors: Gianluca Bustreo, Venice (IT); Paolo Pavanello, Granze (IT); Massimo Carmignoto, Montegrotto Terme (IT); Roberto Zannol, Montegrotto Terme (IT)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 17/631,521

(22) PCT Filed: Dec. 28, 2020

(86) PCT No.: PCT/EP2020/087937
§ 371 (c)(1),
(2) Date: Jan. 31, 2022

(87) PCT Pub. No.: WO2021/151610
PCT Pub. Date: Aug. 5, 2021

(65) Prior Publication Data

US 2022/0270809 A1 Aug. 25, 2022

(30) Foreign Application Priority Data

Jan. 30, 2020 (EP) ..... 20154715

(51) Int. Cl.
*H01F 7/06* (2006.01)
*H01F 41/061* (2016.01)
(Continued)

(52) U.S. Cl.
CPC ..... *H01F 41/061* (2016.01); *H01F 41/122* (2013.01); *H01F 2027/2838* (2013.01)

(58) Field of Classification Search
CPC ..... H01F 41/061
See application file for complete search history.

(56) References Cited

U.S. PATENT DOCUMENTS 4,937,518 A * 6/1990 Donati ..... G01C 9/20 33/366.19
9,583,237 B2 * 2/2017 Pradhan ..... B29C 48/06
(Continued)

FOREIGN PATENT DOCUMENTS

CN 209496640 U 10/2019
DE 2653315 A1 5/1978
(Continued)

OTHER PUBLICATIONS

Korean Decision for Grant of Patent dated Apr. 4, 2022 for Korean Application No. 10-2022-7001552, 3 pages (including English translation).
(Continued)

*Primary Examiner* — Paul D Kim
(74) *Attorney, Agent, or Firm* — Sage Patent Group

(57) ABSTRACT

A method for manufacturing an electric winding of an electromagnetic induction apparatus includes providing a conductor structure and forming an electric winding by means of the conductor structure. The conductor structure includes a conductor element extending longitudinally along a main extension direction and one or more spacer bands arranged on corresponding lateral surfaces of the conductor element. Each spacer band includes a supporting structure made of electrically insulating material and spacer elements made of electrically insulating material arranged on the supporting structure. The spacer elements are spaced one from another along the supporting structure. The electric
(Continued)

winding extends axially along a winding direction and has a plurality of turns arranged around the winding direction. Each turn of the electric winding is formed by a corresponding longitudinal portion of the conductor element. The spacer elements are interposed between adjacent turns of the electric winding at opposite sides of the turns.

20 Claims, 8 Drawing Sheets

(51) Int. Cl.
*H01F 41/12* (2006.01)
*H01F 27/28* (2006.01)

(56) References Cited

U.S. PATENT DOCUMENTS

| | | | |
|---|---|---|---|
| 2020/0195075 | A1 | 6/2020 | Hishida |
| 2021/0319930 | A1 | 10/2021 | Trimmel |

FOREIGN PATENT DOCUMENTS

| | | | |
|---|---|---|---|
| GB | 1242401 | A | 8/1971 |
| JP | S53056736 | A | 5/1978 |
| JP | S54139021 | A | 10/1979 |
| JP | S5717117 | A | 1/1982 |
| JP | H0385708 | A | 4/1991 |
| JP | 2002118020 | A | 4/2002 |
| JP | 2019192785 | A | 10/2019 |
| WO | 9407251 | A1 | 3/1994 |
| WO | 2019219226 | A1 | 11/2019 |
| WO | 2019238558 | A1 | 12/2019 |
| WO | 2018190124 | A1 | 2/2020 |

OTHER PUBLICATIONS

International Search Report and Written Opinion of the International Searching Authority, PCT/EP2020/087937, dated Feb. 25, 2021, 11 pages.
Extended European Search Report dated Mar. 20, 2020 for European Patent Application No. 20154715.5, 9 pages.
Japanese Notice of Grounds of Rejection dated Jul. 26, 2022 for Japanese Patent Application No. 2022-505354, 10 pages (including English translation).

* cited by examiner

METHOD AND CONDUCTOR STRUCTURE FOR MANUFACTURING AN ELECTRIC WINDING OF AN ELECTROMAGNETIC INDUCTION APPARATUS

CROSS REFERENCE TO RELATED APPLICATIONS

This application is a 35 U.S.C. § 371 national stage application of PCT International Application No. PCT/EP2020/087937 filed on Dec. 28, 2020, which in turns claims priority to European Patent Application No. 20154715.5, filed on Jan. 30, 2020, the disclosures and content of which are incorporated by reference herein in their entirety.

BACKGROUND

The present disclosure relates to the field of electromagnetic induction apparatuses for electric power transmission and distribution grids, for example power transformers.

More particularly, the present disclosure relates to a method and a conductor structure for manufacturing an electric winding of an electromagnetic induction apparatus.

Electric windings of electromagnetic induction apparatuses may be manufactured at industrial level according to various methods.

A widely used method consists in winding a conductor around a winding direction, so that the electric winding has a plurality of adjacent turns arranged around said winding direction.

As it is known, generally, electric windings for electromagnetic induction apparatuses have axial and radial channels to ensure the passage of an electrically insulating medium (e.g. insulating fluid or solid cast resin) among the turns.

Traditionally, the axial channels of an electric winding are obtained by arranging insulating blocks oriented in parallel to the winding direction while electrically insulating spacers interposed between adjacent turns of the electric winding and oriented radially with respect to the winding direction are arranged to define the radial channels.

According to most traditional solutions of the state of the art, the above-mentioned insulating spacers are inserted manually between each pair of adjacent turns, during the winding process.

According to more recent manufacturing methods, insulating spacers are fixed along a suitable lateral surface of a conductor intended to form the turns of the electric winding. The conductor structure so obtained is then wound around a winding direction. In this way, insulating spacers take position between each pair of adjacent turns of said electric winding.

State-of-the-art electric windings for electromagnetic induction apparatuses generally perform their functions in a rather satisfying way. However, there are still some aspects to deal with.

In operation, electric windings often show deformed turns, particularly at the regions where radial channels are present.

Basically, this phenomenon is due to the fact that, in operation, an electric winding is subject to huge compressive forces along directions substantially parallel to its winding direction.

The above-illustrated technical issue may lead to a dangerous unbalancing condition of the overall winding structure, which may cause its collapse in certain operating conditions, e.g. when short-circuit currents flow along the electric winding and this latter is subject to huge mechanical stresses. DE 26 53 315 A relates to an isolating- and distancing body for axial isolation and distancing of coil conductors, wherein the isolating- and distancing body fills partly the space in between the conductors, and is formed by an upright isolation stripe which is adjustable to the curvature of the conductors. WO 2019/238558 A1 relates to a band that is applied to a side surface of the multiple parallel conductor in the longitudinal direction of the multiple parallel conductor. The band consists of spacer plates that are arranged in a manner distributed in the longitudinal direction on a strip. The multiple parallel conductor together with the strip and the spacer plates is wrapped with a wrapping. CN 209 496 640 U discloses an oil duct belt for a transposed conductor. The oil duct belt comprises an insulating layer and an insulating oil duct strip arranged on the insulating layer. The insulating oil duct strip comprises a plurality of isolation blocks, which are sequentially arranged at intervals, and a first oil way channel is formed between every two adjacent isolation blocks.

SUMMARY

The present disclosure provides a method and a conductor structure for manufacturing an electric winding of an electromagnetic induction apparatus, which allows the above-mentioned aspects to be overcome or mitigated.

Within this aim, another object of the present disclosure is providing a method and a conductor structure for manufacturing an electric winding, which allow obtaining an electric winding with a high structural balancing and a high resistance to mechanical stresses. Another object of the present disclosure is providing a method and a conductor structure for manufacturing an electric winding, which are relatively easy and inexpensive to implement at industrial level.

This aim and these objects, together with other objects that will be more apparent from the subsequent description and from the accompanying drawings, are achieved, according to the disclosure, by a method for manufacturing an electric winding of an electromagnetic induction apparatus, according to claim 1 and to the related dependent claims.

In a general definition, the method, according to some embodiments, comprises the following steps:

- providing a conductor structure comprising a conductor element extending longitudinally along a main extension direction and one or more spacer bands arranged on a corresponding lateral surface of said conductor element. Each spacer band includes a supporting structure made of electrically insulating material and spacer elements made of electrically insulating material arranged on said supporting structure. Said spacer elements are spaced one from another, along said supporting structure;
- forming an electric winding by means of said conductor structure. Said electric winding extends axially along a winding direction and it has a plurality of turns arranged around said winding direction.

According to some embodiments, each turn of said electric winding is formed by a corresponding longitudinal portion of said conductor element.

According to some embodiments, said spacer elements are interposed between adjacent turns of said electric winding at opposite sides of said turns, when said electric winding is formed.

According to some embodiments, said spacer elements are arranged in such a way to bond with the surface of an adjacent turn, when said electric winding is formed.

According to some embodiments, said spacer elements are formed by shaped pads of electrically insulating material.

In some embodiments, said shaped pads of electrically insulating material are glued on said supporting structure.

In some embodiments, said shaped pads of electrically insulating material have a surface, on which a layer of gluing material is deposited.

According to some embodiments, said spacer elements are formed by shaped regions of electrically insulating material.

In some embodiments, said shaped regions of electrically insulating material are deposited on said supporting structure.

According to some embodiments, each spacer band includes spacer elements arranged on a same supporting surface of said supporting structure.

According to other embodiments, each spacer band includes spacer elements arranged on opposite supporting surfaces of said supporting structure.

According to other embodiments, each spacer band includes spacer elements arranged in such a way to pass through said supporting structure and protrude from opposite surfaces of said supporting structure.

According to some embodiments, each spacer band includes spacer elements made in one piece with said supporting structure.

According to some embodiments, each spacer band includes spacer elements randomly arranged on said supporting structure.

According to preferred embodiments, each spacer band includes spacer elements arranged on said supporting structure according to a predefined geometric pattern.

In some embodiments, said spacer bands are fixed to said conductor element by gluing or by means of an electrically insulating enclosure element wound around said conductor element.

In some embodiments, said conductor element is a continuously transposed conductor.

In a further aspect, the present disclosure relates to a conductor structure for manufacturing an electric winding of an electromagnetic induction apparatus according to the following claim 17.

The conductor structure, according to some embodiments, comprises:

a conductor element extending longitudinally along a main extension direction; and one or more spacer bands arranged on a corresponding lateral surface of said conductor element. Each spacer band includes a supporting structure made of electrically insulating material and spacer elements made of electrically insulating material arranged on said supporting structure. Said spacer elements are spaced one from another, along said supporting structure.

According to some embodiments, each turn of said electric winding is formed by a corresponding longitudinal portion of said conductor element.

According to some embodiments, said spacer elements are interposed between adjacent turns of said electric winding at opposite sides of said turns, when said electric winding is formed.

In yet a further aspect, some embodiments relate to an electric winding for an electromagnetic induction apparatus, according to the following claim 18.

In yet a further aspect, some embodiments relate to an electromagnetic induction apparatus for electric power transmission and distribution grids according to the following claim 19.

In some embodiments, said electromagnetic induction apparatus is an electric transformer for electric power transmission and distribution grids.

BRIEF DESCRIPTION OF THE DRAWINGS

Further characteristics and advantages will be more apparent with reference to the description given below and to the accompanying figures, provided purely for explanatory and non-limiting purposes, wherein.

DETAILED DESCRIPTION

With reference to the aforesaid figures, the present disclosure relates to a method for manufacturing an electric winding 100 of an electromagnetic induction apparatus (not shown) for electric power transmission and distribution grids.

Such an electromagnetic induction apparatus may be an electric transformer for electric power transmission and distribution grids, for example a power transformer or a distribution transformer.

The manufacturing method, according to the disclosure, comprises a step of providing a conductor structure 1 intended to form the electric winding 100.

Figure 1:
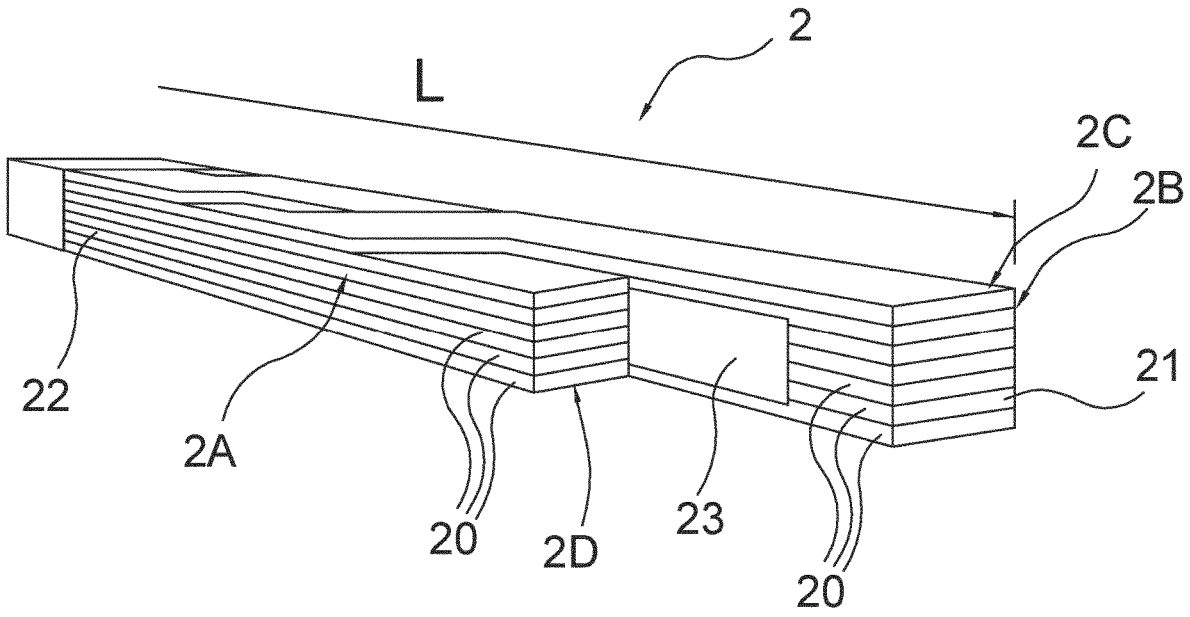
FIG. 1 schematically shows a conductor element used in the manufacturing method and conductor structure, according to some embodiments.

The conductor structure 1 comprises a conductor element 2 extending longitudinally along a main extension direction L (FIG. 1).

In some embodiments, the conductor element 2 is shaped as an elongated parallelepiped including conductive material.

In some embodiments, the conductor element 2 has a shaped section (e.g. a rectangular or square cross section), opposite first and second lateral surfaces 2A, 2B and opposite third and fourth lateral surfaces 2C, 2D.

According to some embodiments of the disclosure, the conductor element 2 is a continuously transposed conductor.

In this case, the conductor element 2 may be manufactured according to the construction shown in FIG. 1.

According to this embodiment of the disclosure, the conductor element 2 comprises two or more stacks 21, 22 of conductors, which are placed side by side along the extension direction L of said conductor element.

Stacked conductors 20 have portions alternating between the above-mentioned stacks 21, 22. In this way, portions of stacked conductors 20 alternately occupy every possible cross section position along the whole longitudinal extension of the conductor element 2.

Stacked conductors 20 may be at least partially covered by electrically insulating material.

The conductor element 2 may include an insulating separator 23 arranged between the stacks 21, 22 of conductors along the extension direction L of said conductor.

The conductor element 2 may include an insulating band or mesh (not shown) wound around the stacked conductors 20 to maintain these latter in position during the winding operations.

According to other embodiments of the disclosure, however, the conductor element 2 may have different constructions (which may be of known type).

For example, it may include a single conductor, a plurality of conductors arranged side by side or a bundle of twisted conductors.

As a further example, the conductor element 2 may be formed by one or more conductive bars or by one or more conductive foils or disks.

According to some embodiments of the disclosure (not shown), the conductor structure 1 include one or more layers of electrically insulating material (not shown) arranged in such a way to externally cover the conductor element 2.

Such an electrically insulating material may be arranged according to solutions of known type. For example, it may be selected in a group of materials comprising: paper, polyester materials, aramid or stabilized-PE materials, fiberglass materials, and the like.

The conductor structure 1 comprises one or more spacer bands 3 arranged on a same corresponding lateral surface 2A or 2B of the conductor element 2.

Each spacer band 3 includes a supporting structure 30 made of electrically insulating material and a plurality of spacer elements 31 made of electrically insulating material and arranged on said supporting structure.

Figure 3:
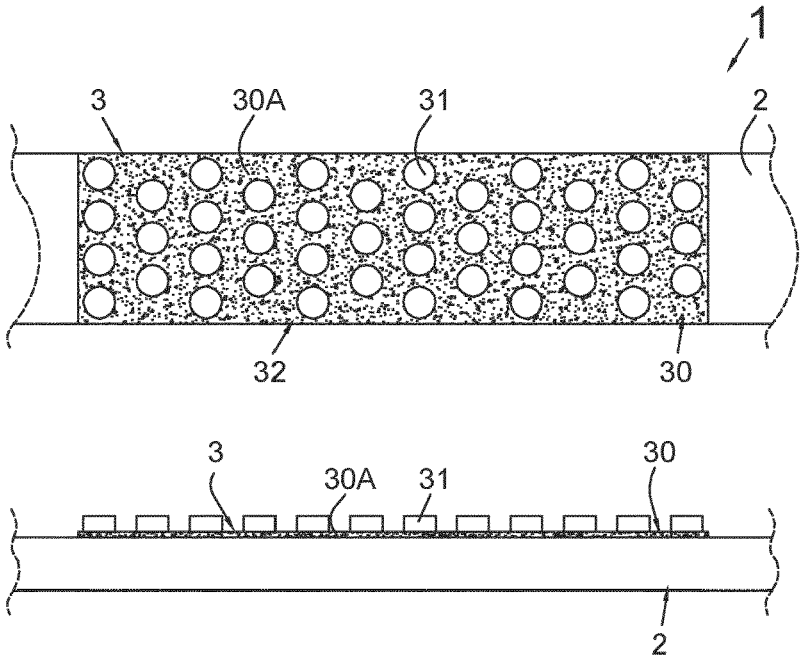
FIGS. 3-4 schematically show a conductor structure, according to some embodiments.

Conveniently, the spacer elements 31 of each spacer band 3 are spaced one from another along the supporting structure 30 to delimit suitable empty regions 32 (FIG. 3, 4, 7).

According to the method of the disclosure, once the conductor structure 1 is obtained, it is carried out a step of forming the electric winding 100 by means of said conductor structure. The electric winding 100 extends axially along the winding direction DW (FIG. 2).

In some embodiments, e.g. when the conductor structure can be bent by means of a suitable bending apparatus, the step of forming the electric winding 100 includes winding the conductor structure 1 around the winding direction DW.

According to alternative embodiments, e.g. when the conductor structure cannot be bent, the step of forming the electric winding 100 may include the step of mechanically connecting separated portions of the conductor structure 1 to form the electric winding 100.

Figure 2:
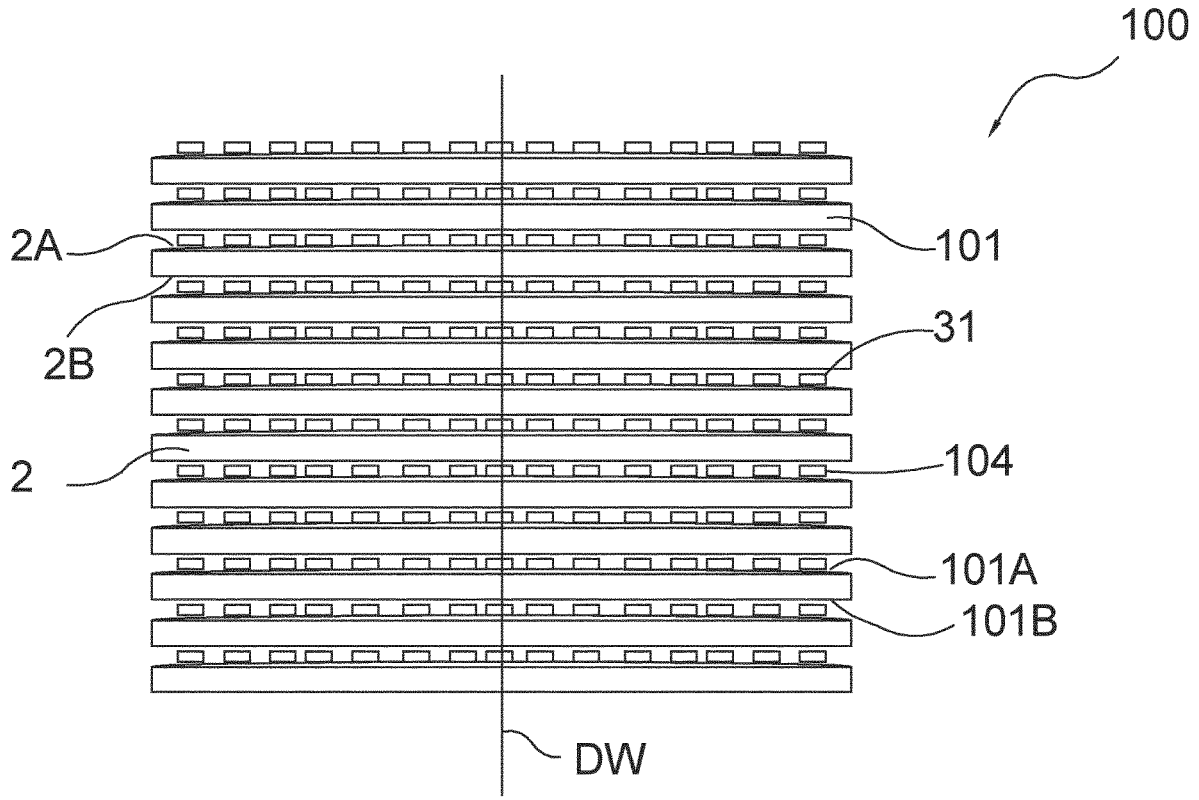
FIG. 2 schematically shows an electric winding for an electromagnetic induction apparatus obtained by means of the manufacturing method, according to some embodiments.

The electric winding 100 has a plurality of adjacent turns 101 arranged around the winding direction DW (FIG. 2).

Each turn 101 is formed by a corresponding longitudinal portion of the conductor element 2 included in the winding structure 1.

In the electric winding 100, the first and second lateral surfaces 2A, 2B of the conductor element 2 are positioned perpendicular to the winding direction DW and form opposite first and second sides 101A, 101B of each turn 101, which extend radially with respect to said winding direction.

Figure 2A:
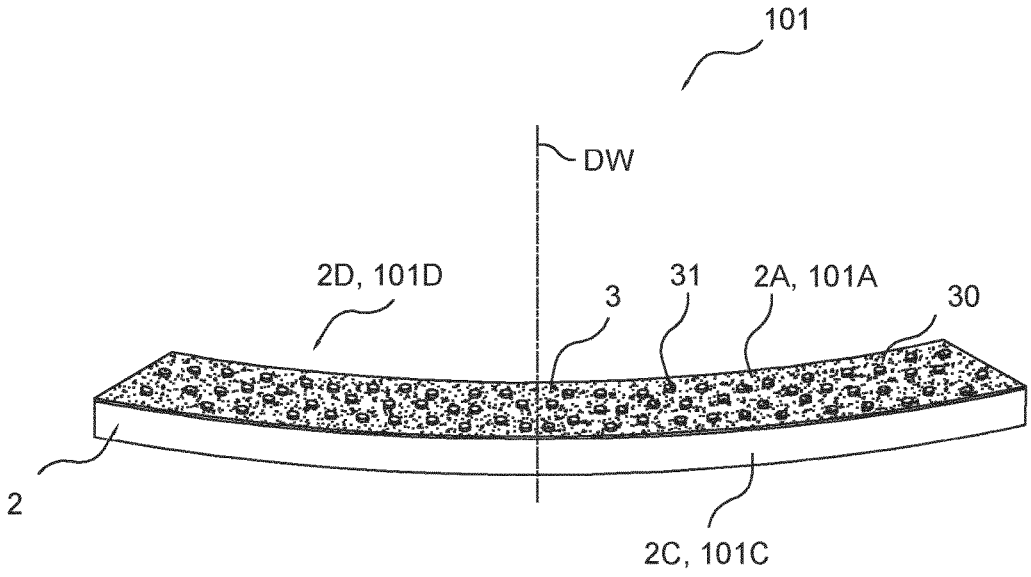
FIGS. 2A, 2B schematically show opposite views of a turn portion of the electric winding of FIG. 2.
Figure 2B:
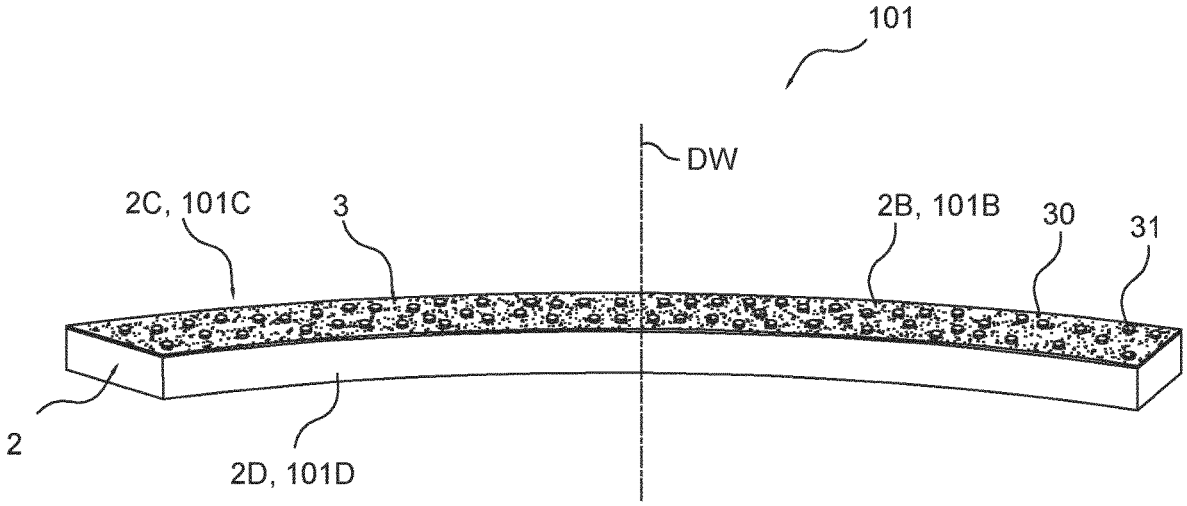

On the other hand, the third and fourth lateral surfaces 2C, 2D of the conductor element 2 are positioned parallel to the winding direction DW and form third and fourth sides 101C, 101D of each turn 101, which extend parallel and coaxially to said winding direction (FIGS. 2A, 2B).

In the electric winding 1, due to their positioning along the first and second surfaces 2A, 2B of the conductor element 2, the spacer elements 31 are interposed between adjacent turns 101 at the first and second sides 101A, 101B of these latter.

In this way, the spacer elements 31 lay on radial planes perpendicular to said the winding direction DW (FIG. 2).

The empty regions 32 delimited by the spacer elements 31 form radial channels 104 of the electric winding 100, which ensure the passage of an electrically insulating medium (e.g. insulating fluid or solid cast resin) among adjacent turns 101.

An important aspect of the disclosure consists in that, in the electric winding 100, the spacer elements 31, which are interposed between each pair of adjacent turns 101 and distributed along the sides 101A, 101B of said turns, provide a substantially uniform mechanical support to the turns 101 and ensure a stable structural balancing of the electric winding 100.

It has been seen that the solution provided greatly improves the overall resistance of the electric winding 100 to compressive forces as it ensures structural balancing.

It is therefore possible to prevent or remarkably mitigate the onset of deformation phenomena of the turns of the electric winding 100 during the operation of the electromagnetic induction apparatus.

In some embodiments, the supporting structure 30 of each spacer band 3 is formed by an elongated element of electrically insulating material having a reduced thickness (e.g. some millimeters) and two main opposite supporting surfaces 30A, 30B.

According to some embodiments, the supporting structure 30 of each spacer band 3 may be formed by a strip of electrically insulating material.

According to other embodiments, the supporting structure 30 of each spacer band 3 may be formed by a molded element of electrically insulating material.

According to yet another embodiment, the supporting structure 30 of each spacer band 3 may be formed by a mesh of electrically insulating material.

In some embodiments, the electrically insulating material used for the supporting structure 30 is selected in a group of materials comprising: paper, plastic materials, fiberglass materials, nylon-based materials.

In some embodiments, the supporting structure 30 has a holed or netting structure to favor the passage of heat during the operation of the electric winding 100.

Figure 4:
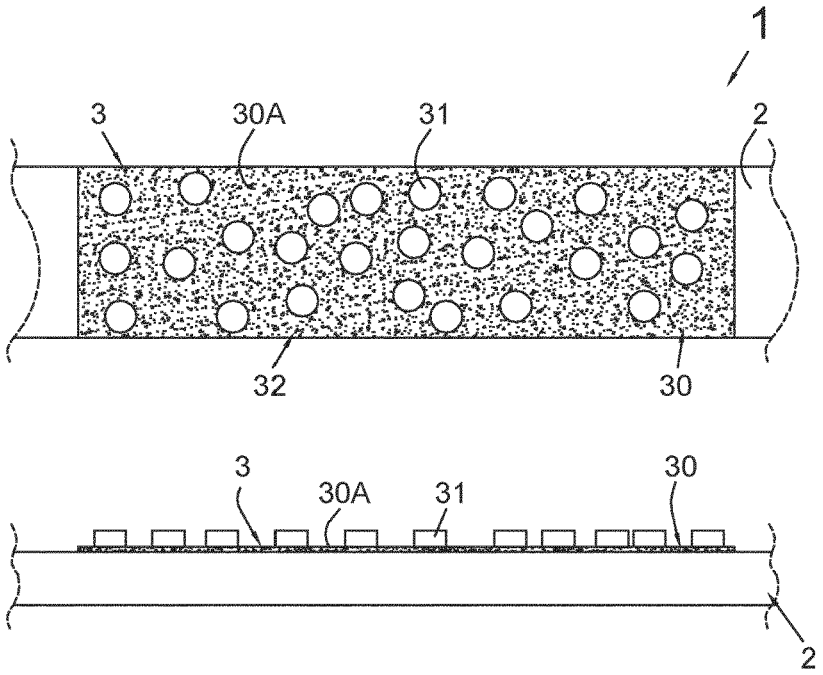

According to some embodiments (FIGS. 3-4), the spacer bands 3 have the spacer elements 31 arranged on a same supporting surface 30A of the supporting structure 30. In this case, the opposite supporting surface 30B of the supporting structure 30 is intended to lay on a lateral surface 2A, 2B of the conductor element 2.

According to other embodiments (not shown), the spacer bands 3 have the spacer elements 31 arranged on both the opposite supporting surfaces 30A, 30B of the supporting structure 30.

Figure 7:
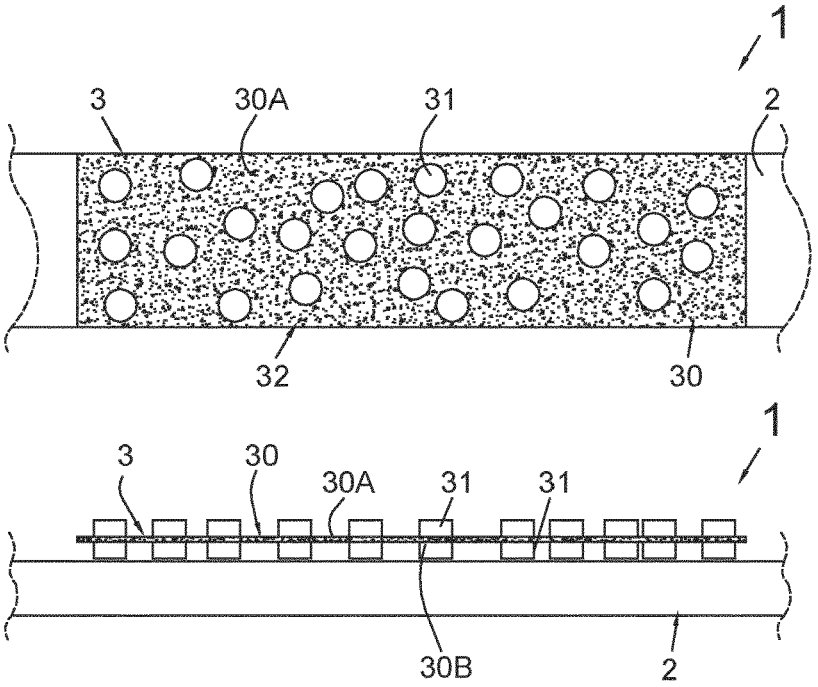
FIG. 7 schematically shows a conductor structure, according to another embodiment.

According to yet other embodiments, the spacer bands 3 have the spacer elements 31 passing through the thickness of the supporting structure 30 and protruding from the opposite supporting surfaces 30A, 30B of the supporting structure 30 (FIG. 7).

In principle, the spacer elements 31 may be arranged on the supporting surfaces 30A and/or 30B of a supporting structure according to any desired layout.

According to some embodiments (FIGS. 3, 7), the spacer bands 3 have the spacer elements 31 arranged in a random manner.

According to other embodiments (FIG. 4), the spacer bands 3 have the spacer elements 31 arranged according to a predefined geometric pattern.

According to some embodiments (in particular where the spacer elements 31 are arranged on a same supporting surface 30A of the supporting structure 30), the spacer bands 3 are fixed to the conductor element 2 by gluing.

Each spacer band 3 may be directly fixed to the conductors of the conductor element 2, or on an insulating layer of said conductor element or on an additional insulating band or mesh surrounding said conductor element.

Glue may be applied to a supporting surface 30B of a supporting structure 30 (opposite to the supporting surface 30A on which the spacer elements are arranged) and/or to the corresponding lateral surfaces 2A, 2B of the conductor element 2 in a known manner, for example by spraying, brushing, dusting, by immersion or by applying a prepreg film activatable by UV radiation or heat.

Special glues designed to withstand high temperatures (e.g. up to 250° C.) may be used.

The above-describe solutions are quite advantageous. Gluing the one or more spacer bands 3 allows preventing or reducing possible undesired dislocations of these latter. Such dislocations of spacer portions 3A, 3B may occur due tangential forces exerted on the winding turns during the operation of the electromagnetic induction apparatus (this phenomenon is also referred to as "spiraling" of the electric winding) or during manufacturing.

According to other embodiments (in particular where the spacer elements 31 are arranged on both the supporting surfaces 30A, 30B of the supporting structure 30 or pass through it), the spacer bands 3 may be fixed to the conductor element 2 by means of an additional electrically insulating enclosure (e.g. formed by an electrically insulating band or mesh wound around the assembly formed by the conductor element 2 and the one or more spacer tapes 3), for example made of a glass-fiber material or polyester.

Also, in this case, the one or more spacer tapes 3 may be directly fixed on the conductors 20 of the electrical conductor element 2, or on an insulating layer of said conductor or on an insulating tape or mesh surrounding said conductor.

In principle, the spacer elements 31 may have any shape according to the needs. As an example, they may have a circular shape, a polygonal shape or even an irregular shape.

In general, the selected size and distribution density of the spacer elements 31 on the supporting structure 30 depend on the type of the winding 100 to be manufactured (e.g. on the magnitude of the stress forces to which the winding 100 is subject and/or on its cooling requirements).

However, the spacer elements 31 may have a relatively small size with respect to the width of the supporting structure 30 on which they are arranged. As an example, they may have a width of 5-10 mm and a height of 2 mm.

In general, the supporting structure 30 and the spacer elements 31 are separated elements assembled through a suitable manufacturing process.

According to preferred embodiments, the spacer elements 31 are arranged in such a way to bond with the surface of an adjacent turn 101, when the electric winding 100 is formed.

As it will be better discussed below, this solution is quite effective in preventing or reducing possible undesired dislocations due to the above-mentioned "spiraling" phenomenon.

Figure 5:
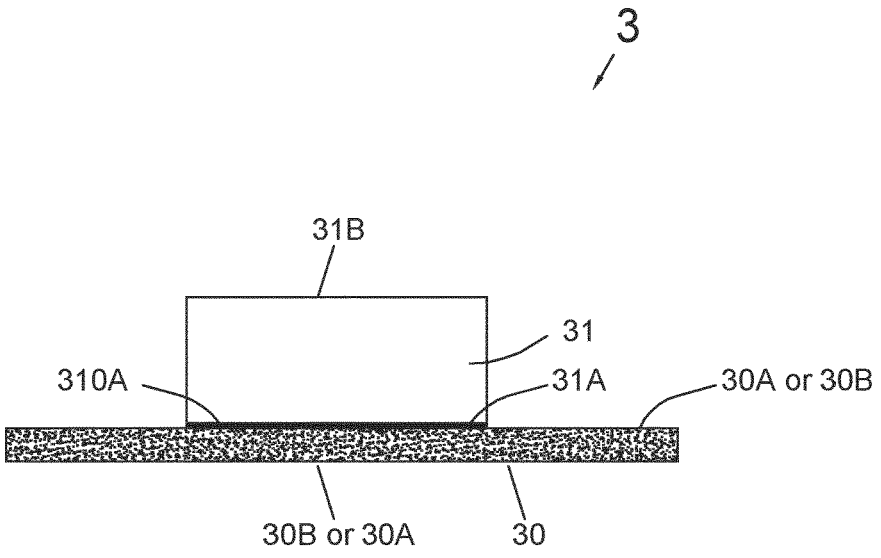
FIGS. 5-6 schematically show some details of a spacer band included a conductor structure, according to some embodiments.
Figure 6:
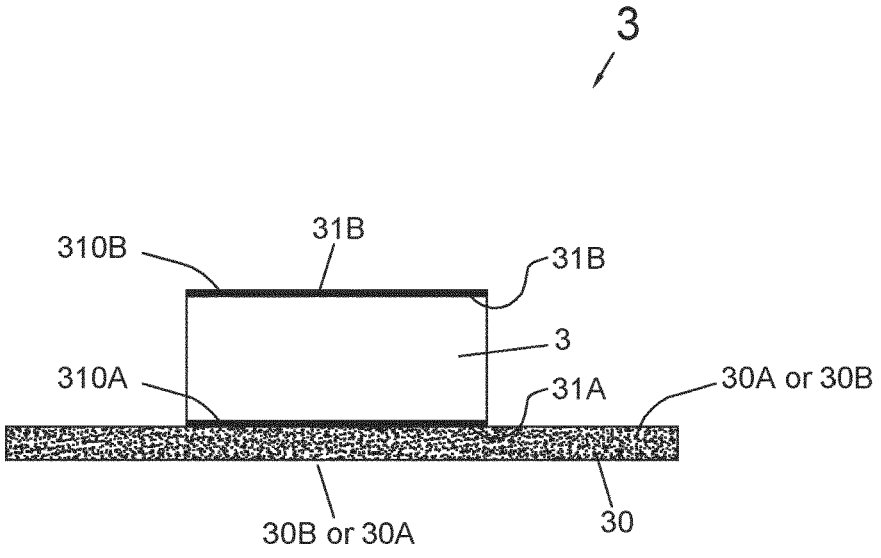
Figure 8:
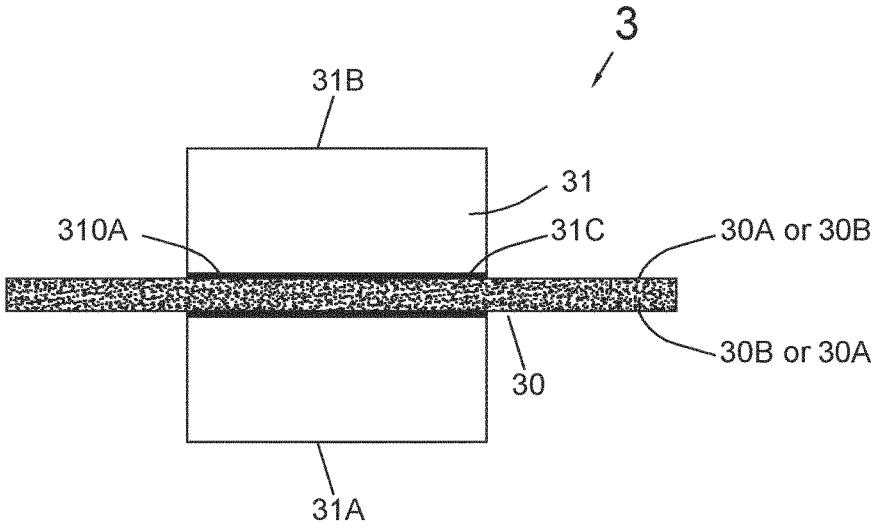
FIG. 8 schematically shows some details of a spacer band included a conductor structure, according to another embodiment.

According to some embodiments, the spacer elements 31 are formed by shaped pads of electrically insulating material (FIGS. 5-6, 8).

In some embodiments, such an electrically insulating material is selected in a group of materials comprising: pressed paperboard, plastic materials, fiberglass materials, nylon-based materials.

In some embodiments, the shaped pads 31 of electrically insulating material are glued on the supporting structure 30.

In some embodiments, when they are arranged on a supporting surface 30A or 30B of the supporting structure 30, the shaped pads 31 of electrically insulating material have a base surface 31A intended to lay on a supporting surface 30A or 30B of the supporting structure 30 and a top surface 31B, opposite to the base surface 31A (FIGS. 5-6).

In some embodiments, the shaped pads 31 of electrically insulating material are glued on a supporting surface 30A or 30B of the supporting structure 30 at their base surface 31A. This can be obtained by depositing a suitable layer 310A of gluing material (e.g. an epoxy resin) on the base surface 31A of each shaped pad 31 and/or on the corresponding region of the supporting surface 30A, 30B on which each shaped 31 is intended to be positioned.

In some embodiments, when they pass through the supporting structure 30, the shaped pads 31 of electrically insulating material have opposite free surfaces 31A, 31B and a lateral surface at which they are glued with a suitable layer of gluing material 310A with the supporting structure 30 (FIG. 8).

In some embodiments, the shaped pads 31 comprise at least a surface 31A, 31B on which an additional layer of gluing material 310B (e.g. an epoxy resin) is deposited.

In the embodiment of FIG. 5, the additional layer of gluing material 310B is conveniently deposited on the top surface 31B of each shaped pad 31 (FIG. 6).

In the embodiment of FIG. 8, the additional layer of gluing material 310B may be conveniently deposited on both the opposite surfaces 31A, 31B of each shaped pad 31 or on one of them only (in this case the surface in distal position with respect to the conductor 2).

The arrangement of an additional layer on at least a surface of the shaped pads 31 is quite advantageous as it allows obtaining (by means of a suitable thermal treatment) the bonding of each shaped pad 31 to both the adjacent turns 101 between which it is positioned, once the electric winding 100 is formed.

This solution thus allows further improving the overall structural strength of the electric winding 100. In particular, this solution is quite effective in preventing or reducing possible undesired dislocations due to the above-mentioned "spiraling" phenomenon.

In some embodiments, the gluing material 310A used for gluing the shaped pads 21 to the supporting structure 30 bonds at ambient temperature.

In some embodiments, the above-mentioned curing temperature (e.g. 100-140° C.) is higher than said bonding temperature (e.g. ambient temperature).

The shaped pads 31 of electrically insulating material may be placed on the supporting structure manually or by means of a suitable equipment, which may be of known type.

The layers of gluing material 310A, 301B may be arranged manually (e.g. by means a suitable tool) or by means of suitable industrial equipment, which may be of known type.

In some embodiments, the gluing material 310B used for covering at least a surface 31A, 31B of the shaped pads 31 has a bonding temperature, at which it bonds (e.g. with the surface of adjacent turn 101), and a curing temperature, at which such an electrically insulating material cures.

Figure 9:
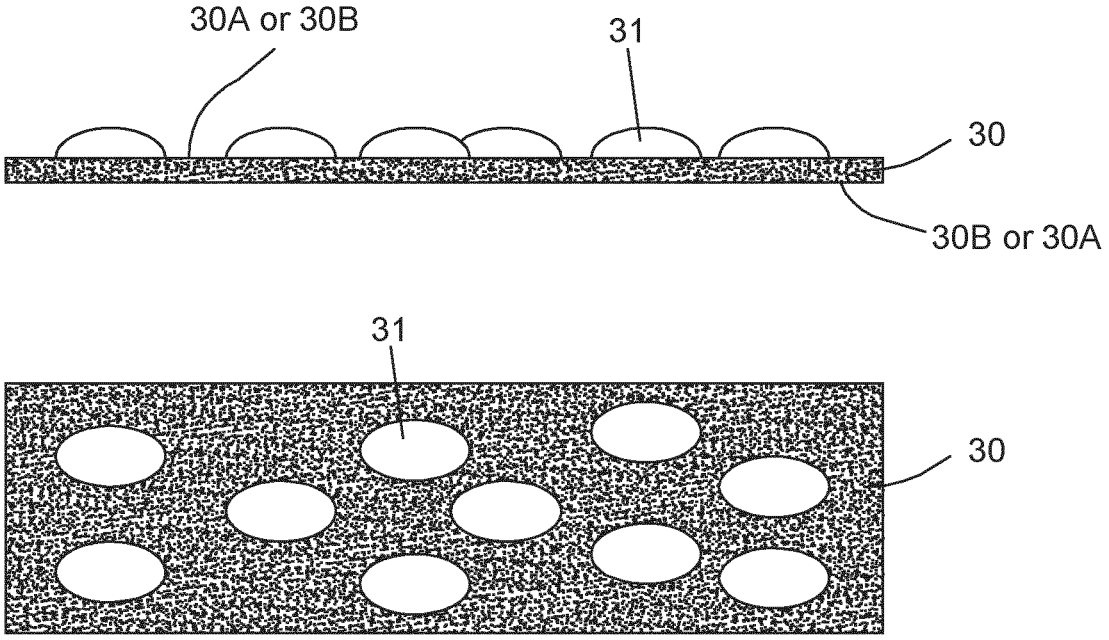
FIGS. 9, 10 and 11 schematically shows a conductor structure, according to another embodiment.

According to some embodiments, the spacer elements 31 are formed by shaped regions of electrically insulating material (FIG. 9).

In some embodiments, such an electrically insulating material is a gluing material (e.g. an epoxy resin) or, more generally, a suitable plastic material.

In some embodiments, the electrically insulating material used for the shaped regions 31 has a bonding temperature, at which such an electrically insulating material bonds (e.g. with the supporting surface 30A, 30B of the supporting structure 30 and the surface of adjacent turn 101), and a curing temperature, at which such an electrically insulating material cures.

In some embodiments, the above-mentioned curing temperature (e.g. 100-140° C.) is higher than said bonding temperature (e.g. ambient temperature).

it is evident that also, according to these embodiment, the spacer elements 31 (in this case formed by shaped regions of electrically insulating material) are arranged in such a way to bond with the surface of an adjacent turn 101, when the electric winding 100 is formed.

In some embodiments, the shaped regions 31 of electrically insulating material are deposited on a supporting surface 30A, 30B of the supporting structure 30, for example in the form of liquid drops.

The shaped regions 31 of electrically insulating material may be placed manually (e.g. by means of a suitable tool) or by means of suitable industrial equipment, which may be of known type.

Since they may have a different thickness when they are deposited on the supporting structure 30, the shaped regions 31 of electrically insulating material may be further subject to a flattening process after the deposition. In this way, the thickness of the shaped regions 31 may be suitably equalized.

According to other embodiments (not shown), the supporting structure 30 and the spacer elements 31 are made in one piece, e.g. through a moulding process.

Also in this case, the spacer elements 31 may have comprise at least a surface on which an additional layer of gluing material (e.g. an epoxy resin) is deposited.

Figure 10:
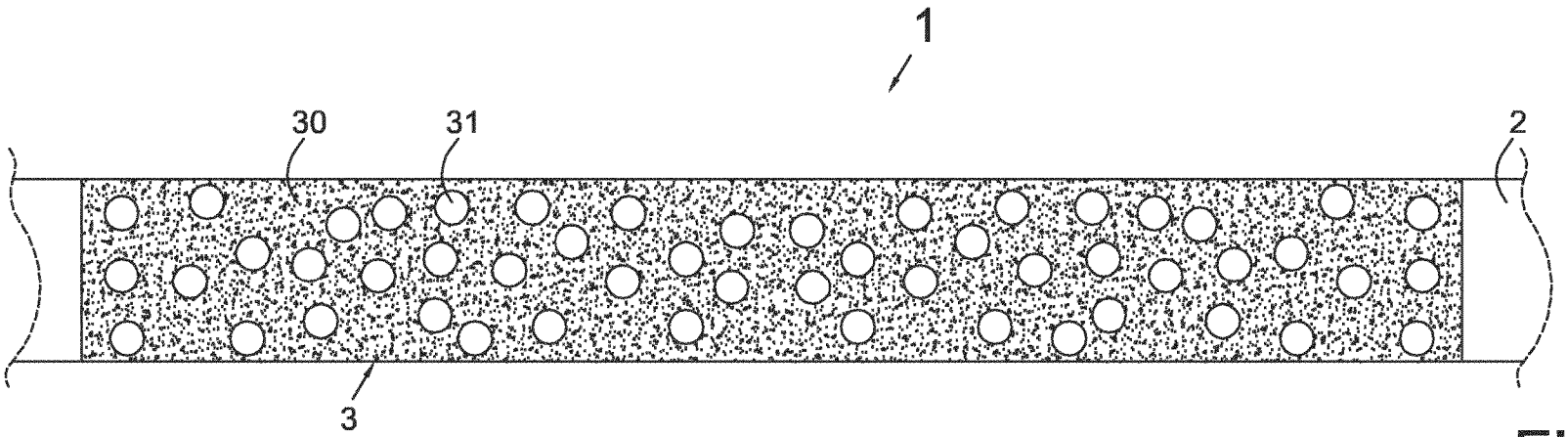

According to some embodiments (FIG. 10), the conductor structure 1 comprises a single spacer tape 3 arranged on a same lateral surface 2A, 2B of the conductor element 2 along the entire length of this latter. In this case, the spacer elements 3 will be continuously distributed on a same lateral surface 2A, 2B along the entire length of the conductor element 2.

According to some embodiments, the conductor structure 1 comprises a plurality of spacer bands 3 arranged on a same lateral surface 2A, 2B of the conductor element 2.

Figure 11:
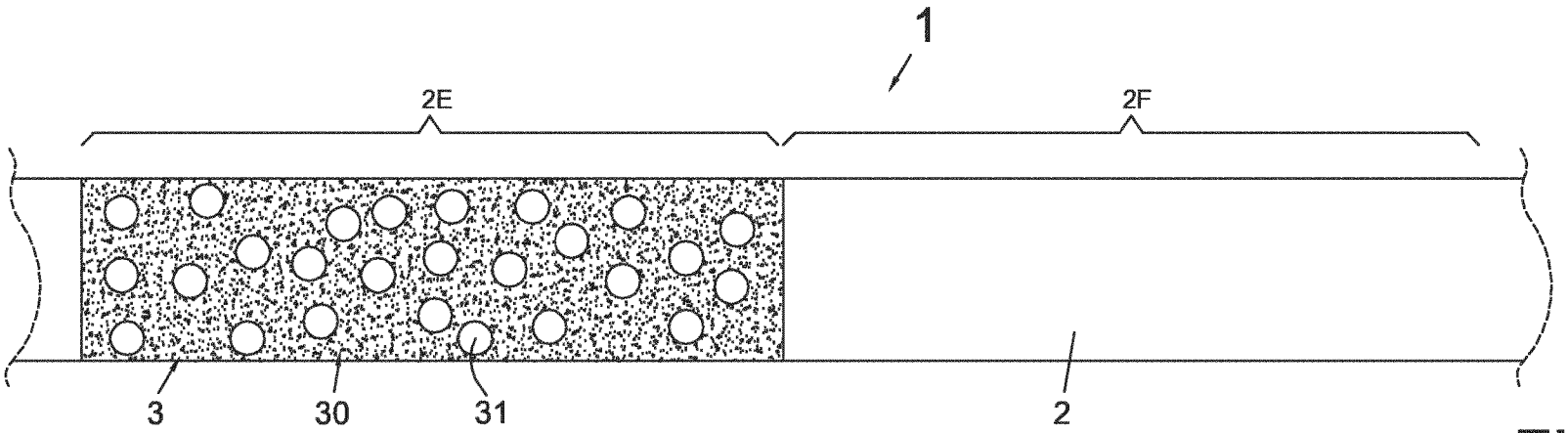

In some embodiments, each spacer tape 3 is arranged on at least a lateral surface 2A, 2B of a corresponding longitudinal portion of the conductor element 2, which is intended to form a turn 101 of the electric winding 100 (FIG. 11).

In some embodiments, the spacer bands 3 are arranged at selected longitudinal portions 2E of the conductor element 2, along the main extension direction L, which are alternate with longitudinal portions 2F, on which no spacer band is present.

Conveniently, each longitudinal portion 2E, 2F has a length (measured along the main extension direction L) equal to the length of a turn 101 of the electric winding 100.

The method and the conductor structure may provide relevant advantages.

The method and conductor structure may allow obtaining electric windings with a high structural balancing and a high resistance to mechanical stresses, in particular to compression stresses.

This may allow preventing or reducing the deformation of the turns of the electric winding in operation with a consequent remarkable increase of the reliability of the electromagnetic induction apparatus in operation, even in presence of fault events or short-circuit events.

The method and conductor structure may be relatively easy to implement at industrial level at competitive costs with respect to known solutions of the state of the art.

The invention claimed is:

1. A method for manufacturing an electric winding of an electromagnetic induction apparatus, the method comprising:

providing a conductor structure comprising a conductor element extending longitudinally along a main extension direction and a spacer band arranged on a lateral surface of the conductor element, the spacer band comprising a supporting structure made of electrically insulating material and a plurality of spacer elements made of electrically insulating material arranged on the supporting structure, the plurality of spacer elements being spaced one from another along the supporting structure; and forming the electric winding by the conductor structure, the electric winding extending axially along a winding direction and having a plurality of turns arranged around the winding direction, wherein each turn of the electric winding is formed by a corresponding longitudinal portion of the conductor structure, wherein the plurality of spacer elements are interposed between adjacent turns of the electric winding at opposite sides of the plurality of turns, and wherein the plurality of spacer elements are arranged to pass through the supporting structure and protrude from opposite surfaces of the supporting structure.

2. The method, according to claim 1, wherein the spacer elements bond with an adjacent turn, when the electric winding is formed.

3. The method, according to claim 2, wherein the shaped pads of electrically insulating material have a surface, on which a layer of gluing material is deposited.

4. The method, according to claim 1, wherein the spacer elements are formed by shaped pads of electrically insulating material.

5. The method, according to claim 4, wherein the shaped pads of electrically insulating material are glued to the supporting structure.

6. The method, according to claim 1, wherein the spacer elements are formed by shaped regions of electrically insulating material.

7. The method, according to claim 6, wherein the shaped regions of electrically insulating material are deposited on the supporting structure.

8. The method, according to claim 1, wherein the spacer band includes spacer elements arranged on a same supporting surface of the supporting structure.

9. The method, according to claim 8, wherein the spacer band includes spacer elements made in one piece with the supporting structure.

10. The method, according to claim 1, wherein the spacer band includes spacer elements arranged on opposite supporting surfaces of the supporting structure.

11. The method, according to claim 1, wherein the spacer band includes spacer elements arranged on the supporting structure according to a predefined geometric pattern.

12. The method, according to claim 1, wherein the spacer bands are fixed to the conductor element by gluing or by means of an electrically insulating enclosure element wound around the conductor element.

13. The method, according to claim 1, wherein the conductor element is a continuously transposed conductor.

14. The method, according to claim 1, wherein the electromagnetic induction apparatus is an electric transformer for electric power transmission and distribution grids.

15. The method according to claim 1, wherein the plurality of spacer elements comprise a plurality of circular spacer elements randomly arranged on the supporting structure.

16. A conductor structure for manufacturing an electric winding of an electromagnetic induction apparatus, the conductor structure comprising:

a conductor element extending longitudinally along a main extension direction;

a spacer band arranged on a lateral surface of the conductor element, the spacer band comprising a supporting structure made of electrically insulating material and a plurality of spacer elements made of electrically insulating material arranged on the supporting structure, the plurality of spacer elements being spaced one from another along the supporting structure, wherein the conductor structure is configured to form the electric winding extending axially along a winding direction and having a plurality of turns arranged around the winding direction, wherein each turn of the electric winding is formed by a corresponding longitudinal portion of the conductor structure, wherein the plurality of spacer elements are interposed between adjacent turns of the electric winding at opposite sides of the plurality of turns, and wherein the plurality of spacer elements are arranged to pass through the supporting structure and protrude from opposite surfaces of the supporting structure.

17. The conductor structure according to claim 16, wherein the plurality of spacer elements comprise a plurality of circular spacer elements randomly arranged on the supporting structure.

18. An electric winding for an electromagnetic induction apparatus, the electric winding comprising:

a conductor structure comprising a conductor element extending longitudinally along a main extension direction and a spacer band arranged on a corresponding lateral surface of the conductor element, the spacer band comprising a supporting structure made of electrically insulating material and a plurality of spacer elements made of electrically insulating material arranged on the supporting structure, the plurality of spacer elements being spaced one from another along the supporting structure;

a plurality of turns arranged around a winding direction, each turn being formed by a corresponding longitudinal portion of the conductor structure, wherein the electric winding extends axially along the winding direction, wherein the plurality of spacer elements are interposed between adjacent turns of the electric winding at opposite sides of the plurality of turns, and wherein the plurality of spacer elements are arranged to pass through the supporting structure and protrude from opposite surfaces of the supporting structure.

19. An electromagnetic induction apparatus for electric power transmission and distribution grids, wherein the electromagnetic induction apparatus comprises the electric winding of claim 16.

20. An electromagnetic induction apparatus for electric power transmission and distribution grids, wherein the electromagnetic induction apparatus comprises the electric winding of claim 18.

* * * * *